United States Patent [19]

Nakanishi et al.

[11] Patent Number: 4,624,606

[45] Date of Patent: Nov. 25, 1986

[54] FOUNDATION IMPROVEMENT PROCESS AND APPARATUS THEREOF

[75] Inventors: Wataru Nakanishi; Tadashi Morimoto, both of Machida, Japan

[73] Assignee: N.I.T. Co., Ltd., Tokyo, Japan

[21] Appl. No.: 767,835

[22] Filed: Aug. 20, 1985

[30] Foreign Application Priority Data

Mar. 12, 1985 [JP] Japan ..... 60-47576

[51] Int. Cl.[4] ..... E02D 3/12; E02D 5/44

[52] U.S. Cl. ..... 405/269; 405/237; 405/241

[58] Field of Search ..... 405/230, 237, 248, 267, 405/269, 232, 231

[56] References Cited

U.S. PATENT DOCUMENTS

| | | | |
|---|---|---|---|
| 3,255,592 | 6/1966 | Moor | 405/237 X |
| 3,786,639 | 1/1974 | Pineno et al. | 405/267 |
| 3,808,823 | 5/1974 | Chelminski | 405/237 X |
| 3,839,875 | 10/1974 | Matsushita | 405/248 |
| 3,851,490 | 12/1974 | Matsushita | 405/248 |

FOREIGN PATENT DOCUMENTS

| | | | |
|---|---|---|---|
| 305235 | 4/1918 | Fed. Rep. of Germany | 405/269 |
| 12716 | 1/1982 | Japan | 405/269 |
| 62212 | 4/1983 | Japan | 405/269 |
| 58-27364 | 6/1983 | Japan | 405/269 |
| 127825 | 7/1983 | Japan | 405/269 |

*Primary Examiner*—Dennis L. Taylor

*Attorney, Agent, or Firm*—Cushman, Darby & Cushman

[57] ABSTRACT

A foundation improvement process comprising providing a first nozzle, a third nozzle, and a second nozzle opened up encircling the first nozzle at the side wall of a lower portion of an injection rod, at the same time providing a diffusion nozzle at an intermediate portion between the first and third nozzles, forming a curtain with a high pressure water jetting from this diffusion nozzle, providing a partition wall between hardening agent jetting from the third nozzle and an air lift portion by means of a fresh water and air jetting from the first and second nozzles by using this water curtain, thereby preventing the raising of the injected hardening agent for performing a sure improvement of a foundation, and at the same time preventing waste of the hardening agent.

2 Claims, 2 Drawing Figures

FOUNDATION IMPROVEMENT PROCESS AND APPARATUS THEREOF

BACKGROUND OF THE INVENTION

This invention relates to a foundation improvement process and an apparatus thereof for improving a foundation by jet-injecting a hardening agent in the ground in order to stabilize a soft and weak foundation.

Conventionally, there is known a foundation improvement process which is disclosed in Japanese Patent Publication (Tokkyo Koho) No. 58(1983)-27364. According to this prior art, improvement of a foundation is performed in the following manner. That is, an injection rod including three flow passages is formed at its lower side wall with a third nozzle communicating with a third flow passage, and spacedly thereabove with a first nozzle communicating with a first flow passage, and a second nozzle encircling the first nozzle and communicating with a second flow passage. And, while pressure-feeding a fresh water to the first and second flow passages, and air to the second flow passage, the injection rod is rotatingly descended into an objective foundation. A jet water jetted from the third nozzle is used as a lubrication liquid and for forming a slurry area. Similarly, jet water jetted from the first nozzle and air encircling the jet water from the second nozzle grind the foundation and at the same time, form the slurry area. Furthermore, due to the air lift effect of the air jetted from the second nozzle, slurry including viscous soil is discharged on the earth. The jet fresh water of the third nozzle is switched over to a hardening agent at a time when the digging degree reaches a predetermined depth, and the rod is lifted while maintaining the jetting of the first and second nozzles. And, while lifting the rod, the hardening agent is injected in the ground for improving the foundation.

However, the conventional process set forth above has the disadvantage that when the rod is lifted while injecting the hardening agent, a part of the hardening agents which was jet-injected in the foundation from the third nozzle is discharged on the earth due to the air lift effect of the fresh water and the air jetting from the first and second nozzles.

SUMMARY OF THE INVENTION

In order to eliminate the above-mentioned disadvantage inherent in the prior art, according to the present invention, there are essentially provided a first nozzle and a third nozzle at the lower side wall of an injection rod, and a second nozzle opened up encircling the first nozzle. At the same time, a diffusion nozzle 7 is formed at an intermediate portion between the first nozzle and the third nozzle, so that a water curtain 16 will be formed by high pressure water jetting from the diffusion nozzle 7. By means of this water curtain, a partition wall is formed between a hardening agent injecting from the third nozzle 9 and an air lift portion by water and air jetting from the first and second nozzles, thereby preventing the raising of the injected hardening agent. In this way, improvement of the foundation is surely performed, and the wasting of hardening agent is prevented.

DETAILED DESCRIPTION OF THE PREFERRED EMBODIMENT

Figure 1:
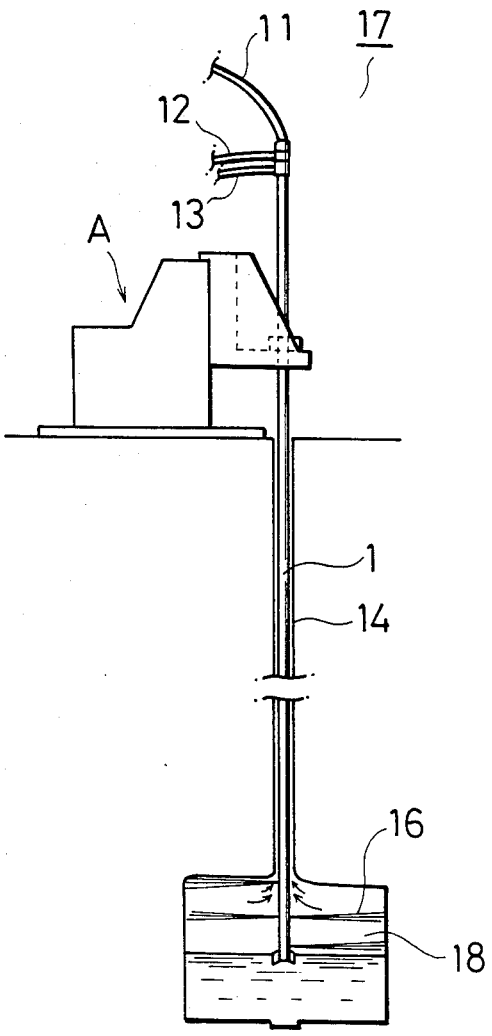
FIG. 1 is a side view of a foundation improvement apparatus according to one embodiment of the present invention.
Figure 2:
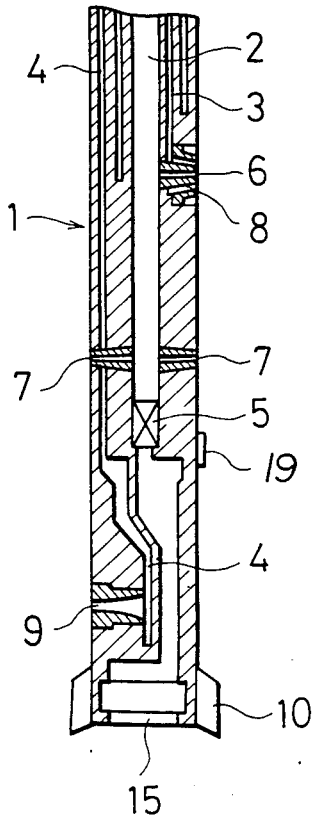
FIG. 2 is an enlarged view of a tip portion of an injection rod to be used for the foundation improvement apparatus of FIG. 1.

In a foundation improvement apparatus 17 shown in FIG. 1, reference numeral 1 denotes an injection rod including three flow passages 2, 3, and 4 (a fourth flow passage is commonly used together with the first flow passage 2) for pressure-feeding a fresh water, air and a hardening agent. The first flow passage 2 serving as a fresh water flow passage communicates with an opening portion 15 at the tip of the rod 1 through a differential pressure regulating valve 5, as shown in FIG. 2. The first flow passage 2 likewise communicates with a first nozzle 6 provided at the side wall of the rod 1 spaced apart from the tip thereof, and a diffusion nozzle 7 for forming a curtain provided at a lower portion of the nozzle 6 and an upper portion of the valve 5.

Reference numeral 8 denotes a second nozzle opened up in an annular shape encircling the first nozzle 6, and communicating with a second flow passage 3 for passing air. Reference numeral 9 denotes a nozzle for jetting a hardening agent. The nozzle 9 is formed in the side wall at the tip of the rod 1 lower than the location of the first nozzle 6 and communicates with the third flow passage 4. Similarly, the aforementioned diffusion nozzle 7 for forming the curtain is provided between the third nozzle 9, and the first and second nozzles 6 and 8. Furthermore, the rod 1 is attached at its tip with digging bits 10.

The rod 1 is caused to rotatingly move upward and downward by a known driving apparatus A. The respective flow passages within the rod 1 are connected to feed mechanisms of a hardening agent, fresh water, and air through respective swivels 11, 12 and 13 in order to feed the fresh water, air, and hardening agent to the objective foundation.

Since the foundation improvement apparatus 17 is such constituted as mentioned above, the injection rod 1 including the three flow passages is held by a chuck of the driving apparatus A in such a manner as to permit the rod 1 to rotatingly move upward and downward. The injection rod is moved downward while rotating or pivoting rightward and leftward in turn in order to dig a hole 14 by the digging bits 10. At this time, the first flow passage 2 of the injection rod is fed with a fresh water, and the second passage 3 is pressure-fed with air. The fresh water fed to the first flow passage 2 passes through the differential pressure regulating valve 5 provided at the first flow passage and jetted from the rod tip to form a lubrication liquid. On the other hand, the air pressure-fed to the second flow passage 3 is jetted from the second nozzle 8 communicating with the second flow passage 3 to produce the air lift effect, thereby discharging soil digged by the digging bits 10 on the earth through the hole 14. When the digging degree reaches a predetermined depth, a high pressure fresh water is fed to the first flow passage 2, and air is succeedingly pressure-fed to the second flow passage 3 to shut the differential pressure regulating valve 5 provided at the tip by using the water pressure (or hydraulic pressure) of the high pressure fresh water pressure-fed to the first flow passage 2, and the rod 1 is lifted while jetting the high pressure fresh water as a side digging jet-liquid from the first nozzle 6. Then, the digging jet-liquid jetting from the first nozzle 6 is enveloped by the air jetting from the second nozzle 8 to prevent the damping of the dig pressure. At the same time, the air jetting from the second nozzle 8 raises the digged viscous soil in order to discharge it on the earth at the time when the air escapes on the earth. Due to the foregoing, a slurry area 18 is formed around the hole 14 by the digging water, and earth and sand washed out. The digging state is measured by a supersonic monitor 19 provided at the side wall of the rod 1. When the slurry area 18 reaches a predetermined range in vastness, a hardening agent is jetted from the third nozzle 9 provided at the lower portion of the rod 1. At this time, the jetted hardening agent is completely isolated from the air jetting from the second nozzle 8 by a water pressure curtain 16 (which is formed around the rod 1 in an membraneous shape in the horizontal direction) formed by a jet-stream of the high pressure fresh water jetting from the diffusion nozzle 7. Accordingly, the hardening agent is not adversely affected by the air lift effect and injected into the surrounding foundation under an appropriate pressure. In this way, while gradually lifting the rod 1, the hardening agent is jetted into the foundation for improvement.

As described in the foregoing, according to the present invention, a foundation improvement is carried out by providing a first nozzle 6 communicating with a first flow passage 2 at the lower side wall of an injection rod including three flow passages, the first flow passage 2 communicating with the tip of the rod through a differential pressure regulating valve 5, providing a second nozzle opened up in an annular shape encircling the first nozzle 6 and communicating with a second flow passage 3, providing a third nozzle 9 communicating with a third flow passage 4 at the tip side of the rod spaced apart by a predetermined distance from the first nozzle 6, providing a diffusion nozzle 7 for forming a curtain at an upper portion of the differential pressure regulating valve 5 between the first nozzle 6 and the third nozzle 9 and communicating with the first flow passage, feeding a fresh water to the first flow passage 2, pressure-feeding air to the second flow passage 3 to dig a hole 14 while effecting the air lift function, rotatingly lifting the injection rod 1 while feeding fresh water and hardening agent, and suceedingly pressure-feeding air to the respective flow passages at a time when the digging degree reaches a predetermined depth, discharging digged soil including viscous soil on the earth by means of the air lift effect of the fresh water and the air jetting from the first nozzle 6 and the second nozzle 8, on the other hand, jet-injecting a hardening agent from the third nozzle 9, and forming a high pressure water curtain by the fresh water jetting from the diffusion nozzle 7 between the first nozzle 6 and the third nozzle 9 for isolating the air lift portion and the hardening agent filled portion from each other. That is, by forming the high pressure water curtain 16 in a membraneous shape between the first nozzle 6 and the third nozzle 9 during the jetting operation of the hardening agent, the hardening agent can be injected and filled into the surrounding foundation under an appropriate pressure without being effected by the air lift. Thus, a sure foundation improvement can be obtained without hardening agents flowed out.

Although the present invention has been described with reference to the preferred embodiment, the embodiment described herein is for illustrative purposes only and not in limitation thereof. Also, the scope of the present invention is defined in the appended claims and will not be binded by description of the embodiment. Accordingly, it will be understood that all changes and modifications which belong to the appended claims fall within the true spirit and scope of the present invention.

What is claimed is:

1. A foundation improvement process comprising:

preparing an injection rod attached at its tip with digging bits and having a first flow passage communicating with an opening portion formed at the tip of said rod through a valve;

providing a first nozzle at this side of said valve communicating with said first flow passage;

providing a second nozzle opened up encircling said first nozzle and communicating with a flow passage different from that of said first nozzle;

providing a third nozzle at a lower location than said first nozzle;

providing a diffusion nozzle at an intermediate position between said first nozzle and said third nozzle;

jetting a lubrication liquid from said opening portion at the tip of said injection rod and air from said second nozzle, while rotatingly descending said injection rod into an objective foundation;

digging a foundation by said digging bits attached to the tip of said injection rod, while discharging soil digged by said digging bits on the earth by means of the air lift effect of the air jetted from said second nozzle;

lifting said injection rod at a time when the digging degree reaches a predetermined depth, while performing jet-stream digging with respect to the side of the foundation by jetting a digging jet-stream under a high pressure from said first nozzle, and at the same time, stretching a jet-liquid curtain by jetting a high pressure diffusion jet-stream from said diffusion nozzle, and jetting a hardening agent from said third nozzle to fill in the digging portion.

2. A foundation improvement apparatus including an injection rod having a first nozzle provided at the side wall of its lower end side and communicating with a first flow passage, a second nozzle communicating with a second flow passage opened up in an annular shape encircling said first nozzle, a third nozzle provided at a lower portion spaced apart by a predetermined distance from said first nozzle and communicating with a third flow passage, and a diffusion nozzle for forming a curtain provided between said first nozzle and said third nozzle and communicating with a fourth flow passage, said injection rod being rotatingly moved upward and downward by driving means.

* * * * *